United States Patent [19]

Nagura

[11] Patent Number: 4,536,094

[45] Date of Patent: Aug. 20, 1985

[54] BELT BUCKLE

[76] Inventor: Keisuke Nagura, No. 12-2, Kotobuki, 1-chome, Daito-ku, Tokyo, Japan

[21] Appl. No.: 559,224

[22] Filed: Dec. 8, 1983

[30] Foreign Application Priority Data

Dec. 9, 1982 [JP] Japan ..... 57-185409[U]

[51] Int. Cl.[3] ..... G04B 37/00

[52] U.S. Cl. ..... 368/278; 224/163

[58] Field of Search ..... 368/276–278, 368/286; 224/152, 163, 180

[56] References Cited

U.S. PATENT DOCUMENTS

| | | | |
|---|---|---|---|
| 1,383,968 | 7/1921 | Perry, Jr. et al. | 368/281 |
| 1,625,040 | 4/1927 | Marcus | 224/163 |
| 1,723,742 | 8/1929 | Marcus | 224/163 |
| 1,878,792 | 9/1932 | Marinsky | 224/163 |
| 2,182,194 | 12/1939 | Blau | 368/277 |
| 4,326,280 | 4/1982 | Perry, Jr. | 368/277 |

FOREIGN PATENT DOCUMENTS

| | | | |
|---|---|---|---|
| 1515415 | 6/1978 | United Kingdom | 224/163 |

*Primary Examiner*—Vit W. Miska

*Attorney, Agent, or Firm*—Toren, McGeady, Stanger, Goldberg & Kiel

[57] ABSTRACT

A belt buckle with a watch unit is disclosed. The buckle comprises a dressed plate, a lock fitting secured to one edge of the dressed plate at the rear side thereof for fixing one end of a belt, a pin secured to the other edge of the dressed plate at the rear side thereof for clamping the belt by inserting it in one of a plurality of clamp holes provided at the other end portion of the belt, a rotatable plate pivotably provided to the edge of the dressed plate at the lock fitting side, and a watch unit embedded in the rotatable plate.

5 Claims, 4 Drawing Figures

BELT BUCKLE

BACKGROUND OF THE INVENTION

The present invention relates to a buckle for a clothing belt, particularly to a belt buckle with a watch unit.

In general, it is unsuitable for a person to put a wrist watch on his or her wrist when playing golf or baseball since the wrist watch is subjected to hard shock.

It has been, then, tried to put a watch on a belt buckle. When the watch is only secured to or buried in a dressed plate provided on the buckle surface whole belt buckle must be moved every time the watch is checked thereby arising not only troublesome but also indecent problem resulting in a practical difficulty. There has been, then, provided a belt buckle capable of burying the watch in the rear surface of the dressed plate which is rotatably fitted to an elliptical frame of the buckle. In this case the watch is hidden from the buckle surface so that the above described indecent problem may be solved. However, the buckle comprises a frame member and a dressed plate as an inevitable element so that the buckle surface is subjected to a limitation in shape thereby causing a design problem.

SUMMARY OF THE INVENTION

It is an object of the present invention to solve the above described problems.

It is another object of the present invention to provide a belt buckle with a watch unit in which a rotatable plate is fitted to a side edge portion of a belt buckle body and a watch is buried therein so that diversity of the belt buckle surface in its design can be obtained and interchange and operation of the watch can easily be performed.

According to the present invention there is provided a belt buckle with a watch unit comprising a dressed plate, a lock fitting secured to one edge of the dressed plate at the rear side thereof for fixing one end of a belt, a pin secured to the other edge of the dressed plate at the rear side for clamping the belt by inserting it in one of a plurality of clamp holes provided at the other end portion of the belt, a rotatable plate pivotably provided to the edge of the dressed plate at the lock fitting side, and a watch unit embedded in the rotatable plate.

The rotatable plate is pivotably provided to the upper or lower side edge of the dressed plate. The rotatable plate is pivotably provided to the upper or lower side edge of the dressed plate by spring first spring. The rotatable plate comprises a snap clamp. The snap comprises a ball provided to the upper and side edge of the rotatable plate through a second spring in such a manner that a part of the ball is projected from the side edge of the rotatable plate in the closed condition thereof, and a recess provided at the upper and side edge of the dressed plate to receive the projected part of the ball in the closed condition of the rotatable plate.

DESCRIPTION OF THE PREFERRED EMBODIMENT

Figure 1:
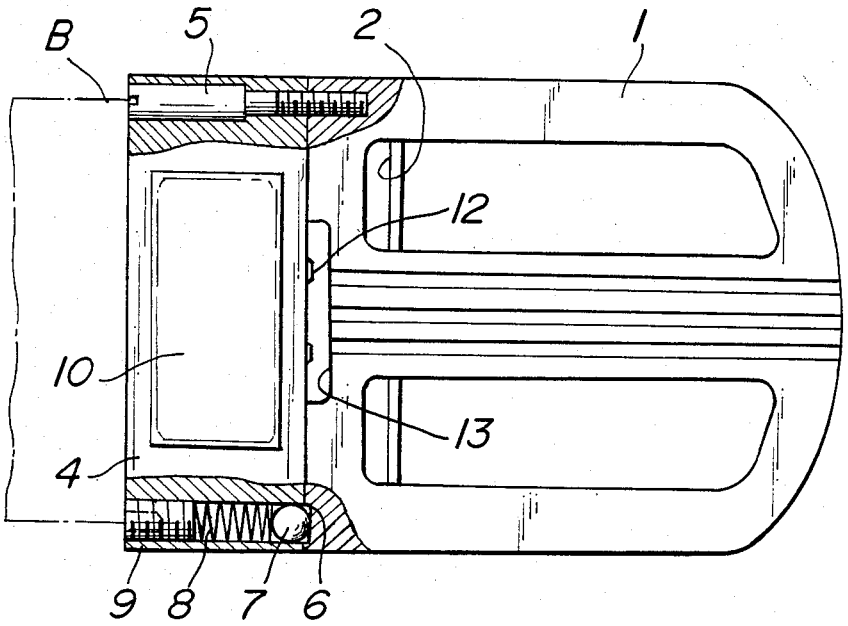
FIG. 1 is a partially broken away front view showing one embodiment of a belt buckle with a watch according to the present invention.
Figure 2:
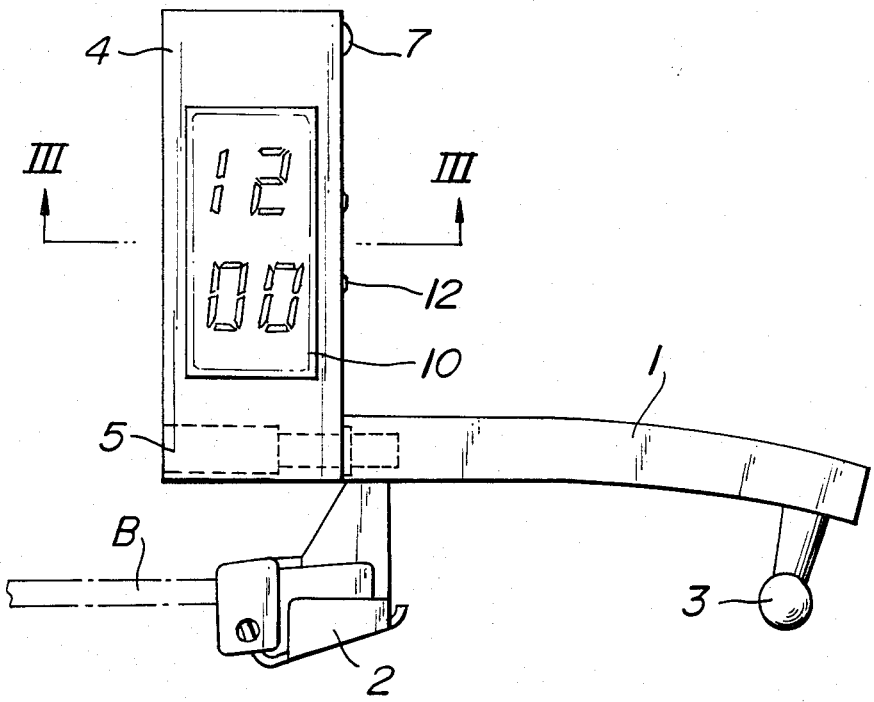
FIG. 2 is plan view illustrating the opened situation of a rotatable plate for use in the belt buckle shown in FIG. 1.
Figure 3:
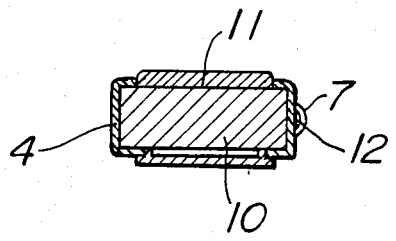
FIG. 3 is a cross-sectional view taken on line III—III of FIG. 2.

Referring now to the drawings, wherein like reference characters designate like or corresponding parts throughout the several views, there is shown one embodiment of a belt buckle according to the present invention.

The belt buckle body comprises a dressed plate 1, a lock fitting 2 secured to one edge portion of the dressed plate 1 at its rear side and for fixing one end of a belt B, and a pin 3 provided to the other edge portion the dressed plate 1 at its rear side and for clamping the belt by inserting it in one of a plurality of clamp holes (not shown) provided at the other end portion of the belt B.

A rotatable plate 4 is mounted to the one edge portion of the dressed plate 1 at the side remote from the lock fitting 2. The rotatable plate 4 has the same thickness and width as the dressed plate 1 thereby obtaining uniformity of both plates 4 and 1. The rotatable plate 4 is pivotably provided at its lower portion to the lower and side edge portion of the dressed plate 1 by a shoulder screw 5 and comprises at its upper end portion a catch or a snap clamp to lock the dressed plate 1 and the rotatable plate 4. In this embodiment the catch or snap clamp comprises a recess 6 provided at upper and side edge portion of the dressed plate 1 and a ball 7 movably provided to the upper and side edge portion of the rotatable plate 4. The ball 7 is secured to the upper and side edge of the plate 4 by a screw 9 through a spring 8 so as to project a part of the ball 7 from the side edge of the plate 4 in the closed condition thereof. A watch unit 10 of digital type is embedded in the center portion of the rotatable plate 4 in such a manner that a display portion 11 of the watch 10 is positioned at rear surface of the rotatable plate 4 and operating buttons 12 are placed at side surface of the plate 4. To this end a notch 13 for accommodating the operating buttons 12 are provided to the central side edge of the dressed plate 1 opposite to the rotatable plate 4. In the use condition the lock fitting 2 of the belt B prevents the rotatable plate 4 from being rotated in the rear direction of the buckle. When time is observed in the condition that the belt is used, the upper portion of the rotatable plate 4 is pulled and rotated in the forward direction by finger to release the engagement of the ball 7 and the recess 6, so that time may easily be observed. The operating buttons 12 are positioned in the notch 13 of the dressed plate 1 in the closed condition of the rotatable plate 4 so that they are not subjected to an erroneous touch and can easily be opened by rotating the plate 4. In case of interchanging a battery of the watch unit 10 a rear lid of the watch 10 placed at the surface of the rotatable plate 4 is removed.

Figure 4:
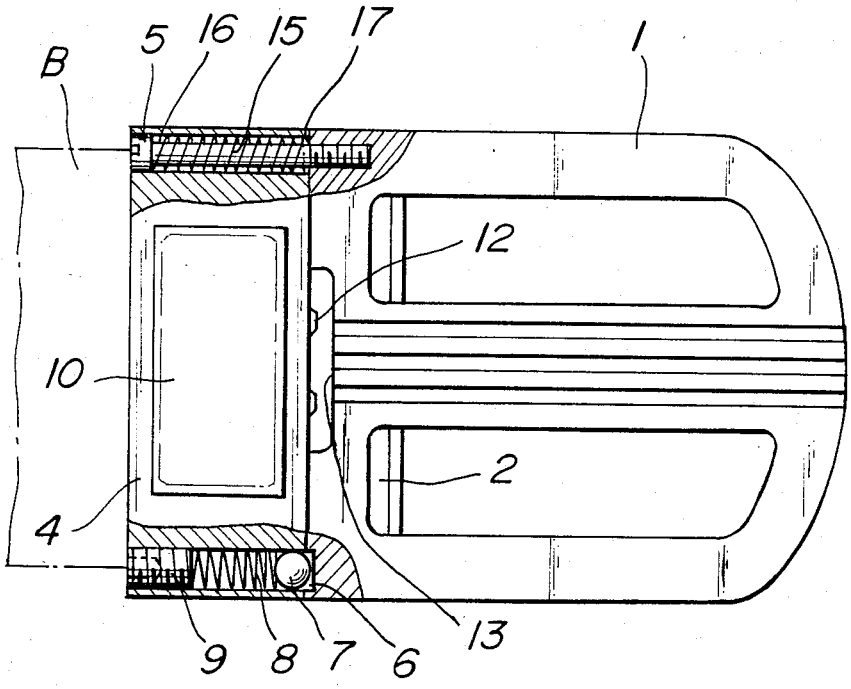
FIG. 4 is a partially broken away front view showing another embodiment of the belt buckle with the watch according to the invention.

Another embodiment of the belt buckle according to the present invention is shown in FIG. 4. In this embodiment the rotatable plate 4 is pivotably provided to the dressed plate 1 by pressing a spring 15 provided in the plate 4 with the screw 5 extending therethrough. The spring 15 is positioned between the shoulder or flange surface of the screw 5 and a step portion 17 provided to a lead-through hole 16 which is formed in the plate 4 so that the plate 4 is rotatably or elastically mounted to the dressed plate 1 by the spring 15. The spring 15 also serves to prevent the loosening of the screw 5, since the head of the screw 5 is pressed by the spring 15.

It is further understood by those skilled in the art that the foregoing description is a preferred embodiment of the disclosed device and that various changes and modifications may be made in the invention without departing from the spirit and scope thereof.

For example the shoulder screw 5 may be provided to the upper portion of the rotatable plate 4 as a pivotal shaft and the display portion 11 of the watch 10 may also be embedded in the surface of the plate 4. In this case the snap clamp is provided at the lower portion of the plate 4. Alternatively, the rotatable plate 4 having the watch 10 embedded therein may easily be interchanged.

What is claimed is:

1. A belt buckle with a watch unit comprising a dressed plate, a lock fitting secured to one edge of the dressed plate at the rear side thereof for fixing one end of a belt, a pin secured to the other edge of the dressed plate at the rear side for clamping the belt by inserting it in one of a plurality of clamp holes provided at the other end portion of the belt, a rotatable plate pivotally provided to the edge of the dressed plate at the lock fitting side, and a watch unit embedded in the rotatable plate, the rotatable plate comprises a snap clamp, the snap clamp comprises a ball provided to the upper and side edge of the rotatable plate through a second spring in such a manner that a part of the ball is projected from the side edge of the rotatable plate in the closed condition thereof, and a recess provided at the upper and side edge of the dressed plate to receive the projected part of the ball in the closed condition of the rotatable plate.

2. A belt buckle as claimed in claim 1, wherein the rotatable plate is pivotally provided to the upper side edge of the dressed plate.

3. A belt buckle as claimed in claim 1, wherein the rotatable plate is pivotally provided to the lower side edge of the dressed plate.

4. A belt buckle as claimed in claim 1, wherein the rotatable plate is pivotally provided to the upper side edge of the dressed plate by a first spring.

5. A belt buckle as claimed in claim 1, wherein the rotatable plate is pivotally provided to the lower side edge of the dressed plate by a first spring.

* * * * *